United States Patent [19]

Santos et al.

[11] 4,280,672

[45] Jul. 28, 1981

[54] COMPACT FIRE HOSE WASHER AND WINDER

[76] Inventors: Frank Santos; Larry E. Santos, both of 2717 Coventry Dr., San Jose, Calif. 95127

[21] Appl. No.: 138,193

[22] Filed: Apr. 7, 1980

[51] Int. Cl.[3] ..... B65H 75/38

[52] U.S. Cl. ..... 242/86; 15/40; 15/88

[58] Field of Search ..... 242/86, 86.2; 15/40, 15/77, 88

[56] References Cited

U.S. PATENT DOCUMENTS

| | | | |
|---|---|---|---|
| 2,179,831 | 11/1939 | Sedgwick | 15/88 |
| 2,320,173 | 5/1943 | Cotton | 15/40 |
| 2,471,041 | 5/1949 | Parker | 15/40 |
| 2,784,432 | 3/1957 | Whaley | 15/40 |
| 2,909,794 | 10/1959 | McGraw | 15/40 |
| 3,827,097 | 8/1974 | Hammann | 242/86 |
| 4,057,198 | 11/1977 | Whitfield | 242/86.2 |
| 4,117,991 | 10/1978 | Johnson | 242/86 |
| 4,206,526 | 6/1980 | Bertram | 15/40 |

*Primary Examiner*—Edward J. McCarthy
*Attorney, Agent, or Firm*—Thomas Schneck

[57] ABSTRACT

A fire hose washer and winder having two reels on opposite sides of a frame. On one side, a hose path is defined along hose guides from one end of the machine to a reel and on the other side of the machine a similar hose path over hose guides is established to another reel. On one side of the machine a hose washing and scrubbing section is positioned such that the hose guides support a hose on a path passing through opposed brushes, with two pipes on opposite sides of the hose path directing water onto opposite sides of the hose, so that a hose can be washed, scrubbed and then wound. On the opposite side of the machine, hoses are brushed and then wound on a reel without washing.

16 Claims, 7 Drawing Figures

COMPACT FIRE HOSE WASHER AND WINDER

BACKGROUND OF THE INVENTION a. Field of the Invention

The invention relates to apparatus for washing, scrubbing and winding a fire hose and simultaneously, or independently, winding a dry hose.

b. Prior Art

The chore of washing, drying and storing fire hoses is as old as mechanized fire fighting. For many years, extending to the present, fire hoses were washed by hand, rinsed, rolled, carried to a drying area, hung to dry and rolled again for storage.

In many jurisdictions firemen are required to continually study problems of fire fighting in an environment characterized by new classes of hazards and materials. They are expected to learn livesaving techniques, first aid procedures and property salvage methods. They are expected to know how to operate and maintain sophisticated fire fighting equipment. Because of these and other demands, many fire departments seek to reduce the time spent by firemen on washing, drying and storing hoses.

Fire hose washing and reeling machines are known. For example, U.S. Pat. No. 2,909,794 shows a machine for washing a fire hose in a tank and then brushing it with roller brushes. U.S. Pat. No. 2,179,831 shows a machine for rinsing a fire hose, brushing it longitudinally, then washing and rinsing it.

While the machines of the prior art are quite useful, one of the problems faced by firemen is that hoses cannot be stored wet. They must be dry. For this reason, some machines of the prior art include driers which heat hoses prior to reeling, as shown in U.S. Pat. No. 3,531,059. In general, this requires large amounts of energy and would be practical only in limited circumstances. Heating of hoses is not the preferred method of drying because rubber or other hose materials may be damaged by heat.

In general, the same machines used in the prior art for washing and reeling wet hoses are not suitable for reeling dry hoses. Conversely, machines for reeling dry hoses are generally not suitable for washing and reeling wet hoses.

An object of the present invention was to devise a machine for washing and reeling wet hoses and simultaneously or independently reeling dry hoses.

SUMMARY OF THE INVENTION

The above object has been achieved with a machine having two reels and having hose guides associated with each reel defining two hose paths. One hose path is for washing and scrubbing a hose and winding the wet hose on a reel; the other hose path is for brushing a dry hose and winding the dry hose on a reel.

Reels and associated guides are mounted on opposite sides of a frame, so that a single compact piece of equipment is suitable for washing hoses and separately winding wet and dry hoses, either simultaneously or independently.

DESCRIPTION OF THE PREFERRED EMBODIMENT

Figure 1:
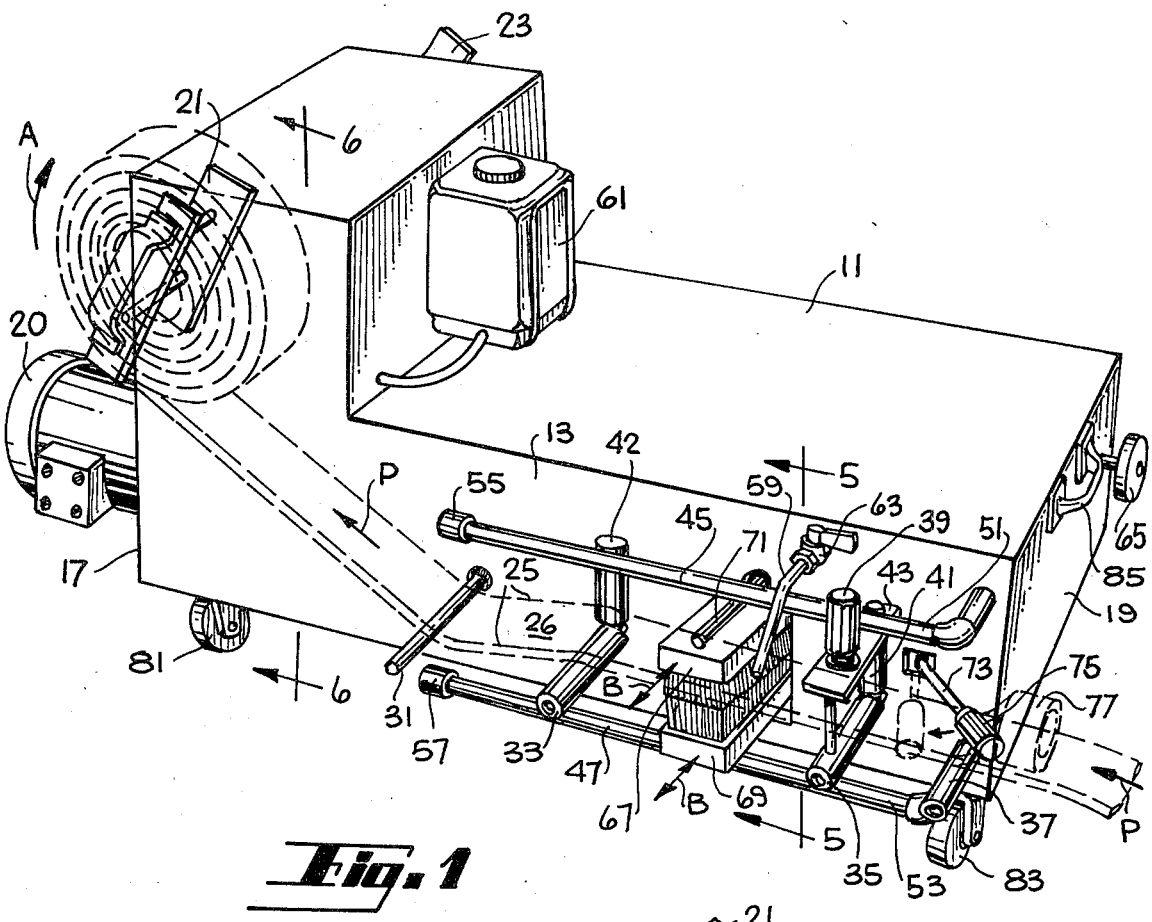
FIG. 1 is a perspective view of a fire hose washing and winding machine of the present invention, showing a hose path for washing a hose and winding the wet hose.
Figure 2:
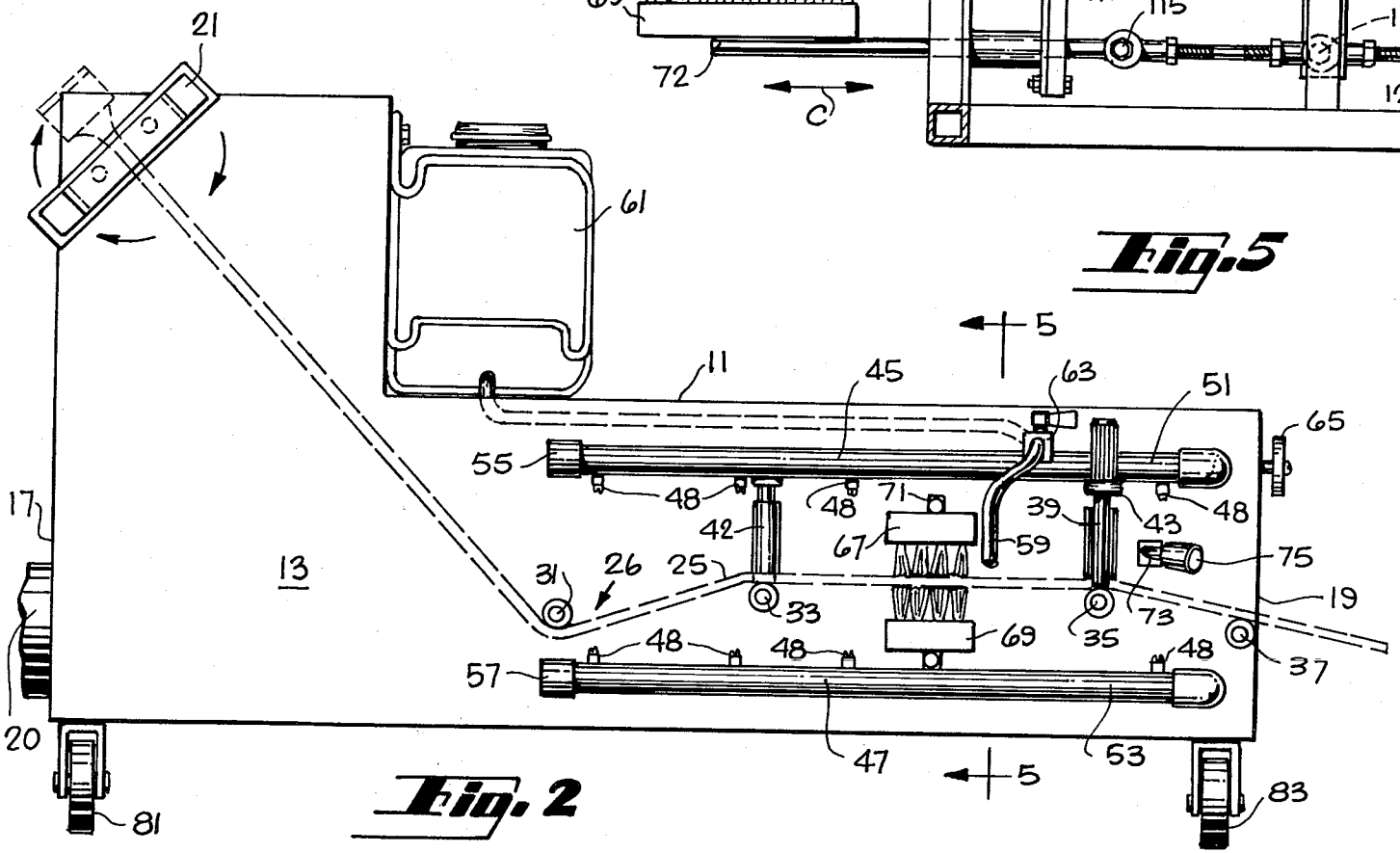
FIG. 2 is a side elevation corresponding to the view illustrated in FIG. 1.

With reference to FIGS. 1 and 2, a compact fire hose washer and winder of the present invention may be seen. The frame 11 has two sides, including a first side 13 and a second side 15, not visible in the views of FIGS. 1 and 2. The two sides are generally parallel and coextensive, extending between opposite ends, including the first end 17 and the second end 19. These sides and ends form a box-like structure which houses most of the motive parts for driving a pair of reels which wind fire hoses.

A first reel 21 is mounted near the first end 17 of side 13 of the frame. A second reel 23 occupies a similar position on the second side of the frame. Reel 21 is mounted on an axle and far enough away from the nearest hose guide so that 50 feet or more of fire hose can be wound on the reel. A plurality of first hose guides 31, 33, 35 and 37 are mounted on the first side 13 of the frame between the first end 17 and the second end 19 for defining a first hose path between the first reel 21 and the second end 19. The hose path is indicated by the dashed lines 25 which show the path a hose 26 would travel with respect to the hose guides and onto driven reel 21 which rotates in the direction of arrow A. The hose which is shown is a flattened fire hose, typically made of canvas and rubber. The invention is not restricted to use with fire hoses, but may be used with any hose which collapses to a flattened configuration, similar to canvas fire hoses. Certain types of hoses which are used for agricultural purposes are similar to fire hoses and may be used with the apparatus of the present invention. The hose guides 33, 35 and 37 are support guides which function to support the fire hose in a path where the hose is washed, scrubbed and rinsed. This path takes the hose through a wash section.

The hose guide 31 is a post positioned immediately above the hose path and serves to change the hose path from a generally flat path through the wash section to an upwardly directed path toward reel 21. The hose guides 31, 33, 35 and 37 have parallel axes and extend in a perpendicular direction away from side 13 of the frame. The hose guides are cantilevered from the frame and have a length slightly greater than the width of the hose.

The hose guides 33 and 35 are ordinarily aligned in a horizontal plane, parallel to the top of frame 11. Another hose guide 39 is aligned in a vertical plane, perpendicular to guides 33 and 35. The hose guide 39 is an edge guide for one of the edges of the hose. The purpose of the guide is to push the edge of the hose inwardly toward the side 13, against another vertical edge guide 41 on the opposite side of the hose. However, the vertical edge guide 41 is fixed, while the guide 39 is laterally adjustable for hoses of slightly different widths. Lateral adjustment is with respect to a support bracket 43 which has holes, grooves or teeth for holding the vertical guide 39 in a desired position. Another vertical edge guide 42 is parallel to guide 41, but closer to reel 21.

The washing section of the apparatus includes two parallel pipes 45 and 47, disposed directly above and below the flat section of the hose path, essentially parallel to it. These pipes carry fresh water and have a plurality of orifices or nozzles 48 for spraying water onto the hose. Some of the nozzles are near the forward ends 51 and 53 of the pipes, while other nozzles are near the end caps 55 and 57, while still other nozzles are in the center of the pipe. The nozzles near the forward ends 51 and 53 function to spray water onto a hose which may be dry and pre-rinse the hose. Nozzles closer to the end caps 55 and 57 rinse the hose after the application of soapy water from nozzle 59. Soapy water flows by gravity feed from a tank 61 and is controlled by a valve 63. On the other hand, fresh water which is used in pipes 45 and 47 comes through a hose connection on side 15, not visible in FIG. 1, and is controlled by the valve 65.

Soapy water is applied onto the hose by nozzle 59 just prior to entry of the hose path between reciprocating brushes 67 and 69. The brushes move in the direction indicated by the double headed arrows B. The brushes are closely spaced to apply tension on the hose between the reel 21 and the brushes. Each of the brushes is similar to a heavy duty household scrubbing brush with stiff bristles and is supported on its backing by a connected support arm, such as arm 71. The support arm may be disconnected from the brush so that the brush may be replaced after it is worn down.

Near end 19 of frame 11, just above or below the hose path, a forwardly projecting, swingable lever 73 is located. Lever 73 swings in a horizontal plane and has an enlarged end 75 made of a resilient material, such as rubber. The purpose of the lever 75 is to automatically stop the washing operation in response to the arrival of a hose coupling indicated by the dashed lines 77. The hose coupling 77 pushes lever 73 toward reel 21 and this shuts off the washing and winding operation. The operation can also be shut off by means of a switch, not shown.

It will be noted that the frame 11 may be pulled over the ground by means of wheels 81, 83 and a handle 85. The entire device is approximately three feet wide, five to six feet long and three feet high at its highest portion, near the reels 21 and 23. The entire washer and winder is compact and readily transportable in the bed of even the smallest of pickup trucks.

Figure 3:
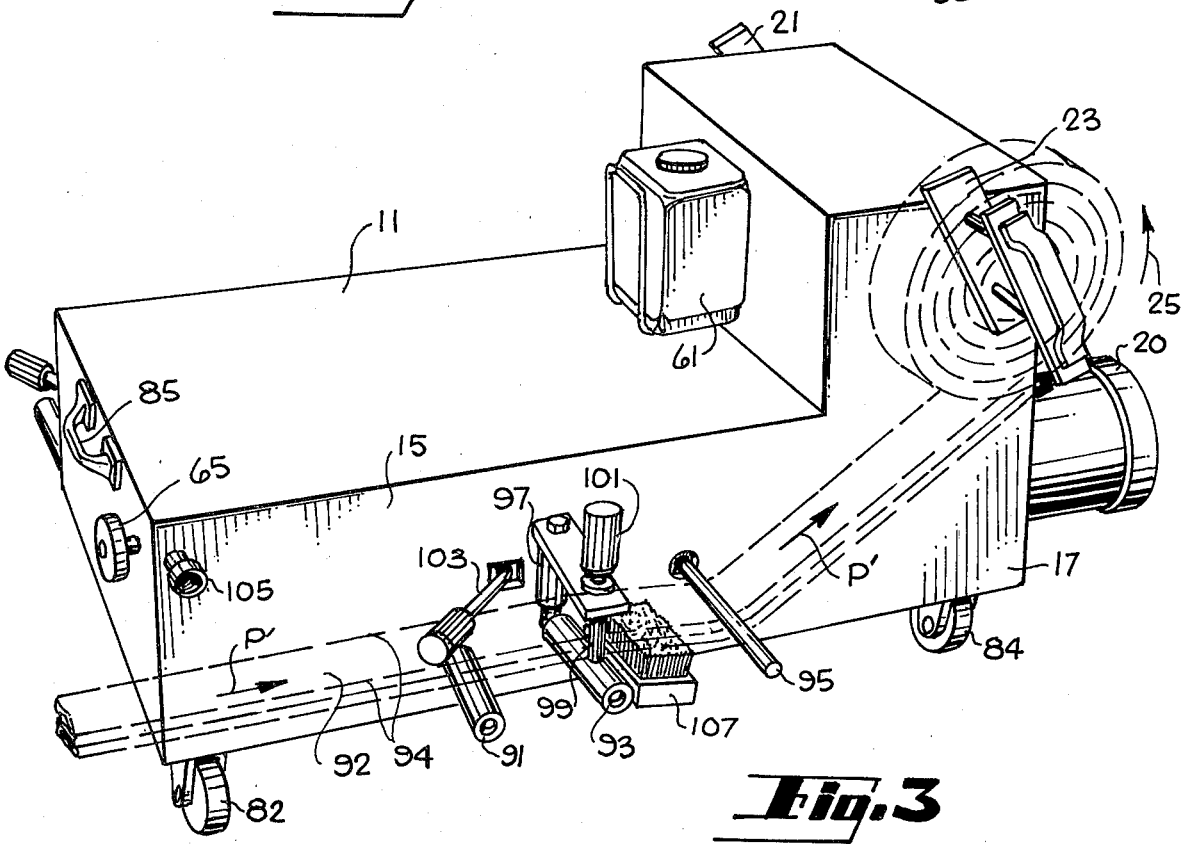
FIG. 3 is a perspective view of a fire hose washing and winding machine of the present invention, showing another hose path, on the opposite side of the machine from the hose path of FIG. 1, for winding a dry hose.
Figure 4:
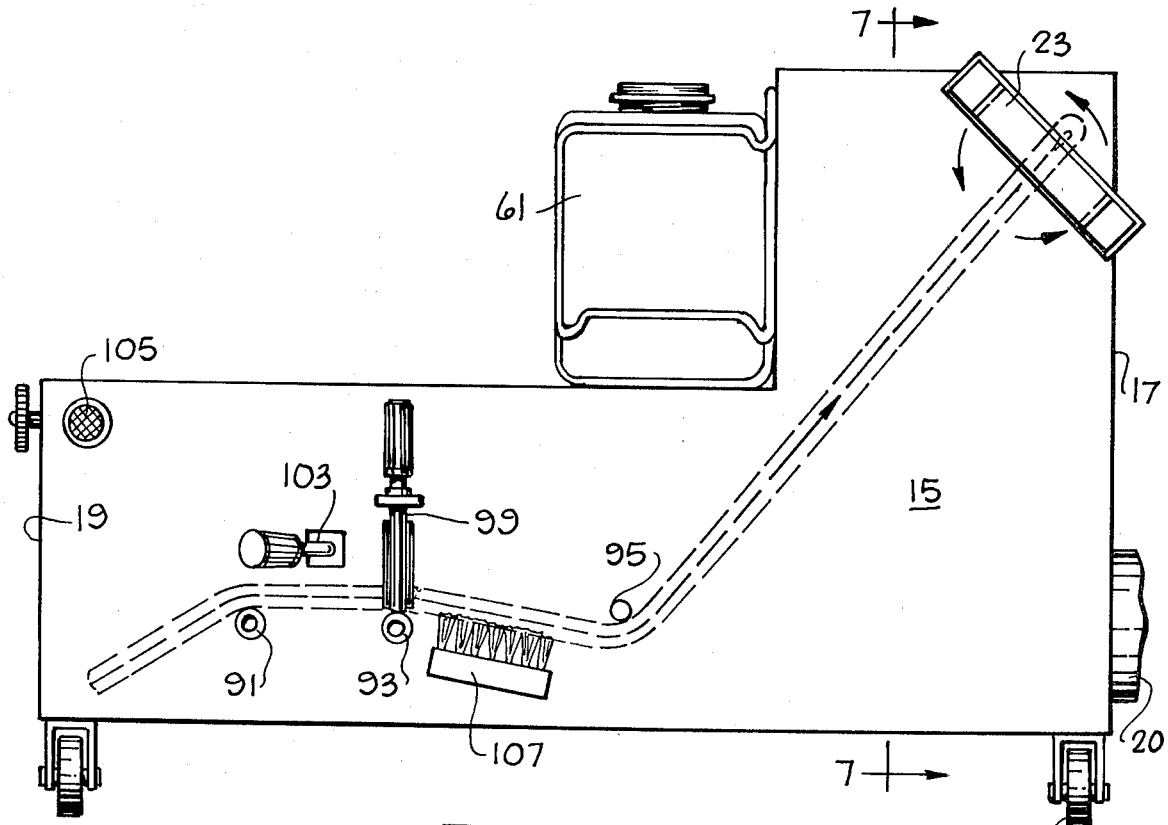
FIG. 4 is a side elevation corresponding to the view illustrated in FIG. 3.

With reference to FIGS. 3 and 4, the side 15, opposite side 13 is illustrated. On this side, a second reel 23 may be viewed having approximately the same position as reel 21 on the opposite side of the frame 11. Both reels may be mounted on a common axle, although they may also be mounted on independent axles so that the reels may be operated independently. A plurality of second hose guides 91, 93, 95 are cantilevered outwardly from side 15 to define a path, indicated by arrow P', for hose 92 indicated by the dashed lines 94 which define the hose path. The second plurality of hose guides 91, 93, 95 all have parallel axes generally parallel to the top of frame 11. Perpendicular to these hose guides are the vertically disposed guides 97 and 99 which serve to guide the opposite edges of hose 92. As previously explained with reference to the movable vertical guide 39, the vertical guide 99 may be laterally adjusted, depending on the width of hose 92. A bracket 101 supports the vertical guide 99 and allows movement toward or away from side 15, depending on the width of a hose. Bracket 101 may have holes, grooves or teeth for allowing the lateral adjustment of vertical guide 99.

It will be noted that a forwardly extending lever 103, corresponds to lever 73 on the opposite side of the machine to act as an automatic shutoff mechanism when a hose coupling pushes the swingable lever 103 rearwardly. A fresh water hose connector 105 is intended to receive water from a garden hose or the like and supply pipes 45 and 47 on the opposite side of the machine.

It will be noted that although there is a plurality of second hose guides on side 15, there is no washing section. A stationary brush 107 is positioned below the path of hose 92 for wiping off dirt, but there is no washing on side 15. This is because the second hose path performs a different function from the first. In operation, a fire hose to be washed is taken by one of its ends and such an end is connected to the center of reel 21 in FIGS. 1 and 2. The machine is then switched on, causing reel 21 to rotate in the direction indicated by the arrow A and causing the hose to move along a path indicated by the arrows P. As the reel 21 turns, fresh water emerges through orifices in the pipes 45 and 47 wetting the hose before and after application of soapy water through nozzle 59. The valve 63 is opened to the desired extent and as soapy water drips onto the hose, the brushes 67 and 69 reciprocate laterally, cleaning the hose. Many fire hoses have small ridges which are perpendicular to the arrows P, i.e. parallel to the axes of the hose guides 31, 33 and 35. By brushing in the direction indicated by the arrows B, the brushes are able to enter the small ridges and remove dirt therefrom. This is an advantage over certain prior art devices in which the bristles move parallel to the direction in which the hose moves.

As the hose is washed, scrubbed and rinsed, it is wound on reel 21 until a hose coupling at the end of the hose trips the swingable lever 73 causing the washing and winding machine to stop. The remainder of the hose is then wound manually on the reel and reel 21 is removed from the machine and taken to a hose drying location, such as a tower. Here the hose is dried after unreeling it. For rewinding the hose, the hose is brought to the machine of the present invention, and usually folded in half. The center of the hose then is placed in the center of reel 23, shown in FIGS. 3 and 4, so that the hose can be rolled in a "double doughnut" roll. The machine is again started with the reel 23 winding in the direction indicated by the arrow 25. The hose follows the path indicated by the arrows P' until one of the hose couplings pushes lever 103 back toward end 17 thereby stopping the machine. The hose is then removed manually from the hose guides and wound manually around reel 23. Then the reel is stored. A replacement empty reel is put on the machine.

Figure 5:
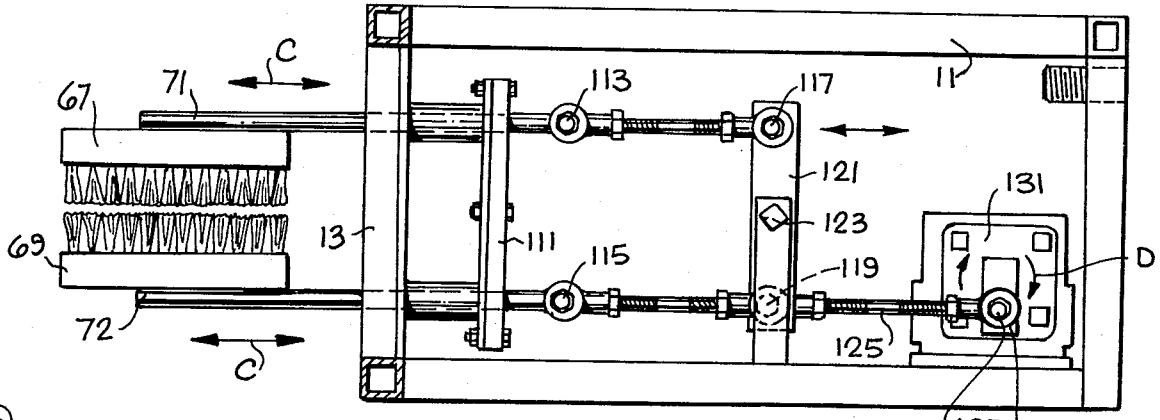
FIG. 5 is a sectional view of the brush means of the present invention taken along lines 5—5 in FIG. 1.
Figure 6:
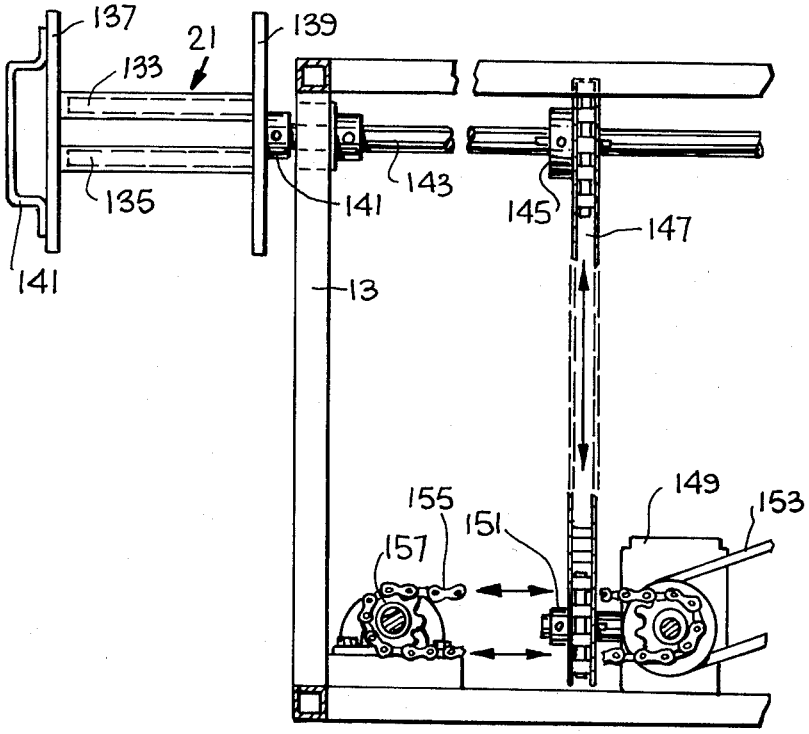
FIG. 6 is a partial sectional view of the drive mechanism for a first driven reel, taken along lines 6—6 in FIG. 1.
Figure 7:
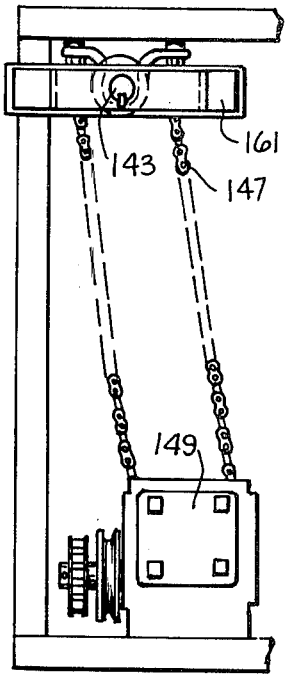
FIG. 7 is a partial sectional view of the drive mechanism for a second driven reel, taken along lines 7—7 in FIG. 4.

The interior workings of the apparatus of the present invention may be viewed with reference to FIGS. 5–7. In the sectional view of FIG. 5, the reciprocating brushes 67 and 69 may be seen to be driven by arms 71 and 72 in the directions of the arrows C. Arms 71 and 72 are supported by yoke 111 inside of frame 11. Yoke 111 is mounted to side 13 of the frame. The arms 71 and 72 terminate in pivots 113 and 115 which are both connected by outer pivots 117 and 119 to a rocker arm 121. Rocker arm 121 rotates about inner pivot 123. One end of the rocker arm is connected at the outer pivot 119 to a drive arm 125 which is connected by another pivot 127 to an eccentric arm 129. Eccentric arm 129 rotates in the directions of arrows D and is driven either by a separate electric motor or by a gear box 131, which in turn is driven by another motor. The gear box 131 has speed reducers (or increasers) for driving the eccentric arm 129 at a speed for reasonable brush stroke action. For example, a brush stroke speed of approximately two strokes per second is reasonable, although faster or slower strokes may be used, depending on the overall speed at which a hose is wound on a reel.

The manner in which a reel is assembled and mounted on the washing and winding apparatus of the present invention is illustrated with reference to FIG. 6. In FIG. 6, the reel 21 is shown to comprise a core formed by two coextensive spaced apart parallel beams 133, 135 between which a hose coupling will fit. The beams have a length equivalent to the width of a hose to be wound. The beams are supported by two parallel opposed flanges 137 and 139 which cause the hose to be wound with one circumferential layer over another. The outer flange 137 is equipped with a handle 141 so that the reel may be easily handled when removed from the machine. The opposite flange 139 has a central sleeve 141 which may be locked onto an axle 143 which emerges through side 113 of the machine. Axle 143 is driven by a pulley 145 mounted on the axle and receiving power through a chain 147 which in turn is connected to a gear box 149 through another pulley 151. The gear box 149 in turn is driven through a belt 153 from a motor, not shown. Gear box 149 transmits power through another chain 155 to a gear 157 connected to the gear box 131 of FIG. 5.

In FIG. 7, the drive mechanism for reel 23 on the opposite side 15 of the machine is shown. The axle 143 is shown to be supported by a bracket 161. The axle projects through the side 15, not shown, and is connected to the reel 23 in the same manner as reel 21 is connected. Chain 147 may be seen to be communicating with the gear box 149.

The motor which provides power to the gear box 149 may be either a gasoline or an electric motor. In the case of an electric motor, the motor may be mounted within the frame, or may be mounted on the outside thereof. In the case of a gasoline motor or engine, it is preferable to mount the engine on the outside of the frame for ease of adjustment, servicing and to supply the engine with air and allow easy escape of exhaust.

An advantage of the present invention is that while washing and winding a hose on one side of the machine, another hose may be wound on the other side of the machine.

We claim:

1. A compact fire hose washer and winder comprising, a frame having two first and second sides between first and second opposite ends, a first driven reel mounted at a first end on the first side of the frame, said first reel having means for engaging an end of a hose, a plurality of first hose guides mounted on the first side of the frame between the first and second ends for defining a first hose path between said first reel, at the first end of the frame, and the second end of the frame, soapy fluid dispensing means disposed along the first hose path near the second end of the frame, rinse water dispensing means disposed along the first hose path, at least part of said rinse water dispensing means disposed between said soapy fluid dispensing means and said first driven reel, moving brush means for scrubbing said hose, said brush means disposed along the first hose path between the soapy fluid dispensing means and the first driven reel, power means mounted on said frame for driving said driven reel and for energizing said brush means, a second driven reel mounted at one of the ends on the second side of the frame, said second reel having means for engaging an end of a hose, said second driven reel connected to said power means for driving power, and a plurality of second hose guides mounted on the second side of the frame between the frame ends for defining a second hose path between opposite ends of the frame.

2. The compact fire hose washer and winder of claim 1 wherein said moving brush means comprises a pair of reciprocating brushes disposed for motion transversely across said hose path with one brush above the hose path and one brush below.

3. The compact fire hose washer and winder of claim 1 wherein at least one brush is disposed along the second hose path for contacting a hose in said second hose path.

4. The compact fire hose washer and winder of claim 1 wherein a first movable lever is disposed adjacent said first hose path in a position for being pushed by a hose coupling from a first position to a second position, said second position causing said power means to stop driving said first driven reel.

5. The compact fire hose washer and winder of claim 1 wherein a second movable lever is disposed adjacent said second hose path in a position for being pushed by a hose coupling from a first position to a second position, said second position causing said power means to stop driving said second driven reel.

6. The compact fire hose washer and winder of claim 1 wherein said first hose guides comprise at least two support guides below the first hose path, said guides having parallel axes projecting from the first side of the frame.

7. The compact fire hose washer and winder of claim 6 wherein said first hose guides further comprise at least one post above the first hose path, said post having an axis parallel to the axes of said two support guides below the first hose path and positioned with respect to said first hose path for directing said first hose path toward said first reel.

8. The compact fire hose washer and winder of claim 6 wherein said first hose guides further comprise a first adjustable edge guide perpendicularly disposed relative to said support guides below the first hose path at opposite lateral edges of said first hose path, said first adjustable edge guide supported by said frame.

9. The compact fire hose washer and winder of claim 1 wherein said second hose guides comprise at least two support guides below the second hose path, said guides having parallel axes projecting from the second side of the frame.

10. The compact fire hose washer and winder of claim 9 wherein said second hose guides further comprise at least one post above the second hose path, said post having an axis parallel to the axes of said two support guides below the second hose path and positioned with respect to said second hose path for directing said second path toward said second reel.

11. The compact fire hose washer and winder of claim 6 wherein said second hose guides further comprise a second adjustable edge guide perpendicularly disposed relative to said support guides below the second hose path at opposite lateral edges of the second hose path, said second adjustable edge guide supported by said frame.

12. The compact fire hose washer and winder of claim 1 wherein said first and second reels are removably mounted relative to said frame.

13. The compact fire hose washer and winder of claim 12 wherein said first and second reels each comprise a core formed by two coextensive, spaced apart parallel beams having beam lengths equal to the width of a flat fire hose, said beams supported between two flanges, one of the flanges being adapted to communicate with said power means for being driven, the other of which has a central handle for carrying a reel upon removal from said frame.

14. The compact fire hose washer and winder of claim 1 wherein said rinse water dispensing means comprises first and second water pipes disposed above and below said first hose path and parallel to said path, said pipes having orifices for spraying water toward said hose path, said orifices in the vicinity of said hose guides.

15. The compact fire hose washer and winder of claim 1 wherein said frame comprises a driven common axle mounting said first and second driven reels.

16. The compact fire hose washer and winder of claim 1 wherein said frame has wheels on the bottom of the frame.

* * * * *